US007246730B2

(12) United States Patent
Russo

(10) Patent No.: US 7,246,730 B2
(45) Date of Patent: Jul. 24, 2007

(54) SMART HANGER SYSTEM

(76) Inventor: Sylvester Russo, 11 Sherrybrooke Dr., Howell, NJ (US) 07731

( * ) Notice: Subject to any disclaimer, the term of this patent is extended or adjusted under 35 U.S.C. 154(b) by 424 days.

(21) Appl. No.: 10/822,241

(22) Filed: Apr. 9, 2004

(65) Prior Publication Data

US 2005/0224532 A1 Oct. 13, 2005

(51) Int. Cl.
*A41D 27/22* (2006.01)

(52) U.S. Cl. ..... 223/85; 223/88; 235/114; 116/308

(58) Field of Classification Search ..... 223/85, 223/88, 92, 98; 116/282, 306, 307, 308; 235/1 C, 114, 115; 40/107, 111, 113
See application file for complete search history.

(56) References Cited

U.S. PATENT DOCUMENTS 1,940,134 A * 12/1933 Levin ..... 235/117 A
3,030,016 A * 4/1962 Rudduck ..... 235/114
3,124,284 A * 3/1964 Collum ..... 223/98
3,346,180 A * 10/1967 Stanley et al. ..... 235/74
3,760,519 A * 9/1973 Niven ..... 235/114
4,173,197 A * 11/1979 Anker ..... 116/223
4,756,104 A * 7/1988 Bailey ..... 40/322
4,886,010 A * 12/1989 Stutzman ..... 116/308
5,564,361 A * 10/1996 Satterwhite ..... 116/308
5,797,527 A * 8/1998 Lam ..... 223/85
5,877,480 A * 3/1999 Tuso et al. ..... 235/1 B
6,330,969 B1 * 12/2001 Villaraut ..... 235/64.7
2002/0066757 A1 * 6/2002 Lee ..... 223/85

FOREIGN PATENT DOCUMENTS

CH 574744 A * 4/1976

* cited by examiner

*Primary Examiner*—Gary L. Welch
*Assistant Examiner*—Nathan Durham
(74) *Attorney, Agent, or Firm*—Ernest D. Buff & Associates, LLC; Ernest D. Buff; Theodore J. Pierson

(57) ABSTRACT

A moisture resistant rustproof smart hanger system provides a set of plastic spindles or thumb wheels permanently attached to a hanger. The spindles are designed to record, for a particular garment, the last cleaned date, the number of times worn, and the last worn date. A user sets the "Last Cleaned" date when a garment or apparel is first placed on the smart hanger; the "Times Worn" indicator is set to 01. The user updates the dates on the "Times Worn" and "Last Worn" record indicators each time the garment or apparel is worn. Each of the thumb wheels is locked by friction or a spring loaded bar that engages teeth on the thumb wheels to prevent accidental rotation.

4 Claims, 1 Drawing Sheet

SMART HANGER SYSTEM

BACKGROUND OF THE INVENTION

1. Field of the Invention

The present invention relates to a smart hanger system and more particularly to a clothes hanger construction that incorporates plastic numbering spindles with locks that convey to the user various information on the article of clothing carried on the hanger.

2. Description of the Prior Art

Many patents address issues related to hanger designs that provide the user with information pertaining to the article of clothing carried on a hanger. These patents disclose various recording means for keeping track of certain information regarding the article of clothing, but the recording means are not moisture resistant, and as a result are prone to rusting. Moisture retention and subsequent rusting of the disclosed recording means occurs during normal usage, resulting from wet or damp articles of clothing being carried on the hanger.

U.S. Pat. No. 3,124,284 to Column discloses a garment wear recorder by way of a paper blank folded over a hanger, wrapping over the upper portion of the hanger. The paper blank has an aperture and tabs, which can be folded one at a time when the garment is worn. The number of folded tabs keeps tally of garment usage. This folding process is destructive to the paper blank. When all the available fold tabs on the paper blank are used, garment usage can no longer be recorded, therefore when the garment usage is greater than the number of fold tabs available on the paper blank, the recording means is ineffective. The paper blank merely allows tallying of the number of times a garment is worn, it does not record the date last cleaned, the date last used, and is disposed to ineffectiveness if the garment's use exceeds the number of fold tabs available. Furthermore, the paper blank used in the '284 patented device is not moisture resistant and is subsequently vulnerable to water damage.

U.S. Pat. No. 4,756,104 to Bailey discloses a message device for use with clothes hangers. A cylindrical message display includes a plurality of stacked relatively rotatable cylindrical segments. Each of the segments is inscribed with messages at discrete radial increments of the peripheral surfaces thereof. The segments are housed in a frame, which clips onto the hook portion of a clothes hanger. By aligning a selection of messages against an index, the state of wear concerning the clothing on the hanger can be displayed. The message device of the '104 patent disclosure is a separate device and is not integral with the hanger. It has to be hung on the hanger; the hanger, itself, does not keep track of the article of clothing usage information. Upper barrel 21 of the message device relates to the upper clothing while the lower barrel 22 of the device relates to the lower clothing. The device displays only one set of information, not a collection of information. Specific information not included by the device comprises the date last cleaned, the date last worn and the number of times the clothing is worn.

U.S. Pat. No. 4,886,010 to Stutzman discloses a clothing wear monitoring device. A garment wear monitor records the number of times an article of clothing is worn. The monitor is removably or permanently affixed to a clothing hanger, or is removably affixed to the garment directly. Each time the garment is worn the garment wear monitor is automatically advanced by one number. As an alternative, the advancement may be accomplished manually. The garment wear monitor may also display the date on which the garment was last cleaned. A threshold indicator serves to remind the user to have the garment cleaned when a predetermined number of wearings have taken place. The garment wear monitor may display the number of wearings and the date of last cleaning by a mechanically movable scale or by an electronic digital display. The '010 patent disclosure describes different configurations of the clothes wear monitor and the device may be of the stand-alone variety, adapted to be attached to a garment or hanger. Alternatively, the device may be permanently attached to the garment hanger. Regardless of the attachment method used, the device only records date cleaned and number of times worn. It has no provision for recording the date of last use of a garment. Being electronic, the device is easily damaged with moisture and is not rustproof.

U.S. Pat. No. 5,564,361 to Satterwhite discloses a clothing usage indicator. Indicia representative of the days of the month, the days of the week, and the months of the year, are shown. Associated indicators are provided for indicating a particular day of the month, a particular day of the week, and a particular month of the year. The associated indicators are movable along the edges and along interior slots in the device. A suitable connector is provided for associating the device with an article of clothing. Preferably, the connector includes a loop or other device whereby an indicator can be slipped over the hooked end of a clothing hanger for association with a particular article of clothing. The device records the date that the article of clothing was last worn. The clothing usage indicator of the '361 patent records last usage date of clothing and has in some arrangements an unprinted area to record notes. This indicator may be attached to a garment or a hanger; but is not permanently affixed to a hanger. It does not record the date last cleaned, or the number of times worn. The arrangements using paperboard or lightweight metal may be vulnerable to moisture and therefore susceptible to rusting.

There remains a need in the art for a low cost, easy to manufacture, moisture resistant, rustproof, smart hanger system wherein a set of indicators permanently affixed to the hanger indicate to the user information regarding the article of clothing hung on the hanger. It would be particularly advantageous if information provided by the smart hanger system included 1) the date the article of clothing was last cleaned; 2) the date it was last worn; and 3) the number of times the article of clothing had been worn subsequent to the last washing or dry-cleaning.

SUMMARY OF THE INVENTION

The present invention provides a moisture resistant, rustproof, smart hanger system having a set of plastic spindles or thumb wheels which record and keep track of the carried garment or apparel's last wear and cleaning dates, and the number of times worn since the last cleaning date. The plastic spindles or thumb wheels are rotatable with printed numeric indicia and are permanently attached to the smart hanger. A plastic tab is also permanently attached to the smart hanger and carries labels containing the printed indicia "Last Cleaned", "Times Worn", and "Last Worn" on three separate lines. A set of plastic spindles or thumb wheels is positioned in line with these labels. The "Last Cleaned" date is recorded using a set of six plastic spindles or thumb wheels. Specifically, the "Last Cleaned" date is set forth so that the first two plastic spindles or thumb wheels represent the month, the second two represent the date, and the last two represent the year. The "Times Worn" number is recorded using a set of two plastic spindles or thumb wheels. The "Last Worn" date is recorded using a set of six plastic spindles or thumb wheels. Like the "Last Cleaned" date the "Last Worn" date is set forth with the first two plastic spindles or thumb wheels representing the month, the second two representing the date, and the last two representing the year. The plastic spindles or thumb wheels are prevented from accidental rotation by use of locking means, which may be friction assisted or a spring loaded bar that is pressed against teeth carried by thumb wheels.

This numbering system is located on the hanger in a prominent position, so as to be readily visible. It conveys information to prospective wearers of an article of clothing carried by the hanger. Among the information conveyed are details concerning: (i) the date the article of clothing was last washed or dry-cleaned; (ii) the date the article of clothing was last worn; and (iii) the number of times the article of clothing was worn after the last washing or dry cleaning event. A prospective wearer of the clothes sets the "Times Worn" and "Last Worn" spindles when hanging clothing on the unit and resets the "Date Cleaned" after the article of clothing is washed or dry-cleaned. The system thereafter continuously conveys the clothing's cleaning and wearing history to the user.

The smart hanger with garment or apparel usage information indicating indicia can be constructed of any rust proof plastic material, preventing damage to the garment or apparel placed on the smart hanger. Advantageously, the moisture resistant recording prevents discoloration, or degradation, of the recorded information even when the garment or apparel gets wet. The locking devices may include friction devices with or without spring loading and may include a spring-loaded bar.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
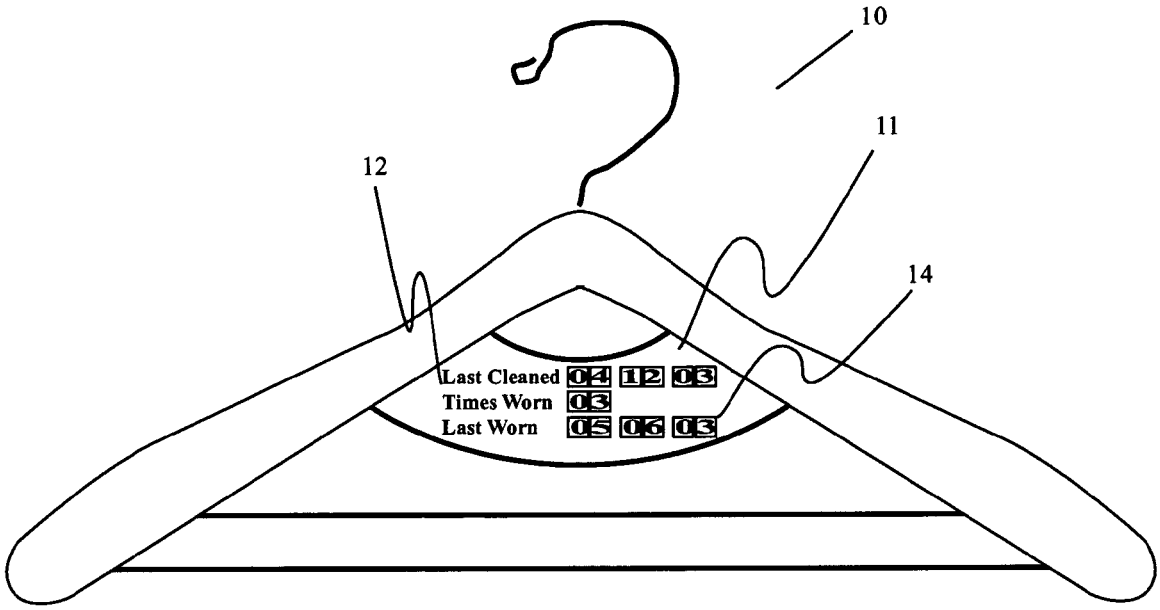
FIG. 1 is a diagrammatic representation of the smart hanger.

The present invention relates to a smart hanger system having sets of plastic spindles or thumb wheels integrally attached to the hanger on three discrete lines. The plastic spindles carry indicia for recording the last cleaning date; the last wear date; and the number of times a garment carried by the smart hanger has been worn. The plastic spindles or thumb wheels have a lock to prevent accidental alteration of the recorded numbers. The plastic spindles or thumb wheels are moisture resistant, and are rust proof.

Referring to FIG. 1, the smart hanger system is shown generally at 10. The smart hanger carries a plastic tab at 11, which has printed label indicia at 12 indicating "Last Cleaned", "Times Worn" and "Last Worn". Adjacent to each printed line there is a set of plastic spindles or thumb wheels. These plastic spindles or thumb wheels can be rotated by pushing the wheels with the thumb to align particular indicia representing a date or a number, as shown at 14. The rotating thumb wheels are provided with a locking provision to prevent accidental alteration of indicia selected.

The "Last Cleaned" indication is recorded on six thumb wheels, as shown. The first two thumb wheels represent the month. The first wheel has indicia numbers of 0 and 1, and the second thumb wheel has indicia numbers 0, 1, 2, 3, 4, 5, 6, 7, 8 and 9. The next two thumb wheels represent the date. The first thumb wheel has indicia numbers of 0, 1, 2, and 3, and the second thumb wheel has 0, 1, 2, 3, 4, 5, 6, 7, 8 and 9 indicia numbers. The year is represented by the last two thumb wheels. The first thumb wheel has indicia numbers of 0, 1, 2, 3, 4, 5, 6, 7, 8 and 9 and the second thumb wheel has 0, 1, 2, 3, 4, 5, 6, 7, 8 and 9 indicia numbers.

The month may also be conveniently represented by a wheel having twelve individual positions, on which are printed, respectively, the months of Jan, Feb, Mar, Apr, May, Jun, Jul, Aug, Sep, Oct, Nov and Dec.

The "Times Worn" indication has two thumb wheels. The first thumb wheel has indicia numbers of 0, 1, 2, 3, 4, 5, 6, 7, 8 and 9 and the second thumb wheel has 0, 1, 2, 3, 4, 5, 6, 7, 8 and 9 indicia numbers.

The "Last Worn" indication is recorded on six thumb wheels similar to the "Last Cleaned" indicator. The first two thumb wheels represent the month. The first wheel has indicia numbers of 0 and 1, and the second thumb wheel has 0, 1, 2, 3, 4, 5, 6, 7, 8 and 9 indicia numbers. The next two thumb wheels represent the date. The first thumb wheel has indicia numbers of 0, 1, 2, and 3, and the second thumb wheel has 0, 1, 2, 3, 4, 5, 6, 7, 8 and 9 indicia numbers. The last two thumb wheels represent the year. The first thumb wheel has indicia numbers of 0, 1, 2, 3, 4, 5, 6, 7, 8 and 9 and the second thumb wheel has 0, 1, 2, 3, 4, 5, 6, 7, 8 and 9 indicia numbers.

The month may also be conveniently represented by a wheel having twelve individual positions, on which are printed, respectively, the months of Jan, Feb, Mar, Apr, May, Jun, Jul, Aug, Sep, Oct, Nov and Dec.

The lock mechanism may be a simple friction lock, wherein the thumb wheels are held in compression by a spring against the plastic tab with a rectangular window opening to show the selected numeric indicia. Thus pressing the plastic spindles against an opening in the smart hanger plastic tab 11 provides sufficient friction preventing accidental alteration of indicia selected. Alternatively, a spring-loaded bar may engage teeth on thumb wheels to capture their position.

In use, the user manually sets the date cleaned first and the date worn; then sets the indicia for times worn as 01 and locks the plastic spindles. When the garment is worn a second time, the last wear date and the number of times usage indicia are changed and locked. Thus, these three sets of spindles provide accurate information concerning the last cleaning date, last wear date, and number of times the garment is worn. This device is inexpensive to construct and reliable in operation. It is permanently attached to the hanger, so that the usage indicia thereon are prominently visible. The use of plastic spindles in the smart hanger system provides moisture resistant rustproof indication.

The key features of the smart hanger includes a combination of the features set forth below:

1. A rustproof plastic spindle or thumb wheel system for recording the cleaning date, the last wear date and the number of times an article of clothing has been worn, with locks to prevent accidental alteration of recorded data;
2. First recording means for recording the date an article of clothing was last washed or dry-cleaned;
3. Second recording means for recording the number of times the article of clothing was worn after the last washing or dry cleaning;
4. Third recording means for recording the date the article of clothing was last worn; and
5. Attachment means for permanently attaching the recording means to a clothes hanger.

The smart hanger, with article usage indicia, can be constructed of any rustproof plastic material and the locking devices may include friction devices with or without spring loading.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A smart hanger system for a clothes hanger, comprising:

a. a rustproof moisture resistant plastic spindle or thumb wheel recording system for recording the cleaning date, the last wear date and the number of times an article of clothing has been worn;

b. attachment means for permanently attaching the recording system to a clothes hanger;

c. first recording means carried by said hanger for recording the date an article of clothing was washed or dry-cleaned, wherein said first recording means includes a set of six thumb wheels, a first two of said thumb wheels indicating month, a second two of said thumb wheels indicating date and a last two of said thumb wheels indicating year;

d. second recording means for recording the number of times the article of clothing was worn after the last washing or dry cleaning; and e. third recording means for recording the date the article of clothing was last worn;

whereby the first, second and third recording means are positioned in line with printed label indicia on a plastic tab permanently attached to said smart hanger indicating "Last Cleaned", "Times Worn", and "Last worn", respectively.

2. A smart hanger system as recited by claim 1, wherein said second recording means includes first and second thumb wheels, each of which has numeric indicia comprising 0, 1, 2, 3, 4, 5, 6, 7, 8 and 9.

3. A smart hanger system for a clothes hanger, comprising:

a. a rustproof moisture resistant plastic spindle or thumb wheel recording system for recording the cleaning date, the last wear date and the number of times an article of clothing has been worn;

b. attachment means for permanently attaching the recording system to a clothes hanger;

c. first recording means carried by said hanger for recording the date an article of clothing was washed or dry-cleaned;

d. second recording means for recording the number of times the article of clothing was worn after the last washing or dry cleaning; and e. third recording means for recording the date the article of clothing was last worn, wherein said third recording means includes a set of six thumb wheels, a first two of said thumb wheels indicating month, a second two of said thumb wheels indicating date and a last two of said thumb wheels indicating year;

whereby the first, second and third recording means are positioned in line with printed label indicia on a plastic tab permanently attached to said smart hanger indicating "Last Cleaned", "Times Worn", and "Last worn", respectively.

4. A smart hanger system as recited by claim 3, wherein said second recording means includes first and second thumb wheels, each of which has numeric indicia comprising 0, 1, 2, 3, 4, 5, 6, 7, 8 and 9.

* * * * *